United States Patent [19]

Andolora

[11] Patent Number: 4,825,558

[45] Date of Patent: May 2, 1989

[54] PIN BAR FOR MOUNTING FLEXOGRAPHIC PRINTING PLATES

[75] Inventor: Joseph A. Andolora, Caledonia, N.Y.

[73] Assignee: Adflex Corporation, Rochester, N.Y.

[21] Appl. No.: 95,960

[22] Filed: Sep. 14, 1987

[51] Int. Cl.[4] ..... B41F 27/00; B41B 1/00

[52] U.S. Cl. ..... 33/621; 101/DIG. 36

[58] Field of Search ..... 101/DIG. 12; 294/67.4, 294/74, 81.55; 269/130–132; 33/621, 618, 614

[56] References Cited

U.S. PATENT DOCUMENTS

| | | | |
|---|---|---|---|
| 661,470 | 11/1900 | Fawell | 294/74 |
| 2,104,553 | 1/1938 | Claybourn | 101/DIG. 12 |
| 2,174,882 | 10/1939 | Huebner | 101/DIG. 12 |
| 2,334,821 | 11/1943 | Howley | 101/DIG. 12 |
| 2,559,533 | 7/1951 | Daniels | 101/DIG. 12 |
| 3,070,056 | 12/1962 | Hill | 269/131 |
| 3,580,626 | 5/1971 | Hilburn | 294/74 |
| 4,061,087 | 12/1977 | Hill . | |
| 4,380,956 | 4/1983 | Elworthy . | |
| 4,449,452 | 5/1984 | Mansell | 101/DIG. 12 |
| 4,460,028 | 7/1984 | Henry | 269/131 |
| 4,569,286 | 2/1986 | Bleckmann | 101/DIG. 12 |
| 4,603,641 | 8/1986 | Jeschke | 101/DIG. 12 |
| 4,604,811 | 8/1986 | Roosen . | |

FOREIGN PATENT DOCUMENTS

| | | | |
|---|---|---|---|
| 696877 | 10/1965 | Italy | 101/DIG. 12 |

*Primary Examiner*—Clifford D. Crowder

*Attorney, Agent, or Firm*—Stonebraker, Shepard & Stephens

[57] ABSTRACT

A pin bar 10 for mounting flexographic printing plates 25 on print cylinders 20 is formed as an angle bar 11 having two pairs of bearing regions spaced apart on two parallel lines near the bar edges 14 so that the bearing regions can all engage the cylindrical print surface of a print cylinder to align the bar parallel with the axis 21 of the engaged cylinder. Pins 40 for mounting the plate are axially movable in a slot 50 that extends parallel with the lines for the bearing regions. A set screw 45 holds each of the alignment pins 40 in a selected axial position in slot 50, and a clamp on each end of the bar includes a chain 36 that can wrap under a cylinder shaft 24 and be tensioned by a screw 30 and a hand nut 31 for holding bar 10 firmly in position on cylinder 20.

25 Claims, 4 Drawing Sheets

PIN BAR FOR MOUNTING FLEXOGRAPHIC PRINTING PLATES

BACKGROUND

Flexographic printing plates are adhered to cylindrical print cylinders with a double sided adhesive material, known as "sticky back." This is wrapped around and stuck to the cylinder so that the outer surface of the sticky back is covered by a release sheet. Location holes are bored in the plates, and to ensure that each plate is accurately aligned with each cylinder, pin bars are used to dispose a row of pins along the length of the cylinder, to fit the location holes bored in the plates. Once a pin bar is properly located on a cylinder, and a plate is properly positioned by the pin bar, a portion of the release sheet over the sticky back is cut away, and the matching region of the flexible plate is adhered to the exposed sticky back, to fix the plate in its located position. Then the plate is removed from the pin bar, the pin bar is removed from the cylinder, the release sheet is removed from the rest of the sticky back, and the rest of the plate is adhered to the sticky back around the full circumference of the cylinder.

The pin bars available for mounting flexographic plates this way have been cumbersome and difficult to clamp in an accurately axial position on the cylinder. Their pins have been fixed in axial positions from which they are selectively removable, and these have been inconvenient to accommodate to plates having pin holes in varying locations. Pin bars have also been expensive and have typically fit only a single size cylinder so that they have been required in large numbers, representing a substantial investment. Examples of such prior art pin bars are shown in U.S. Pat. Nos. 4,604,811, and 4,380,956.

I have devised a more convenient pin bar that is easier to use for mounting flexographic printing plates. My pin bar clamps quickly and simply in a position that is accurately parallel with the cylinder axis. Its plate mounting pins are movable axially for speed and convenience in matching the holes drilled in the plates, and once the pins are set in the proper position for a series of plates, they automatically fit all the plates in the series. A single size of my pin bar can fit several sizes of cylinders, and my pin bars are simpler and less expensive than the ones previously available.

SUMMARY OF THE INVENTION

My pin bar for mounting flexographic printing plates on print cylinders has two pairs of bearing regions spaced apart on two parallel lines so that the bearing regions can all engage a cylindrical print surface to align the bar parallel with the axis of the engaged cylinder. An axial slot in the bar extends parallel with the bearing region lines, and several plate alignment pins are movable axially along the slot. A set screw holds each of the alignment pins in a selected axial position in the slot. A clamp at each opposite end of the pin bar has a tension element, such as a chain, that can wrap around a shaft of the cylinder and be drawn tight to hold the pin bar firmly in place on the cylindrical surface. The chain clamp is preferably tightened by a screw and a hand nut, the pin bar is preferably formed as an angle bar, and opposite sides of the slot preferably have reference surfaces recessed into the pin bar so that guide blocks on the pins can be recessed in the bar surface to engage the reference surfaces.

DRAWINGS

DETAILED DESCRIPTION

Figure 1:
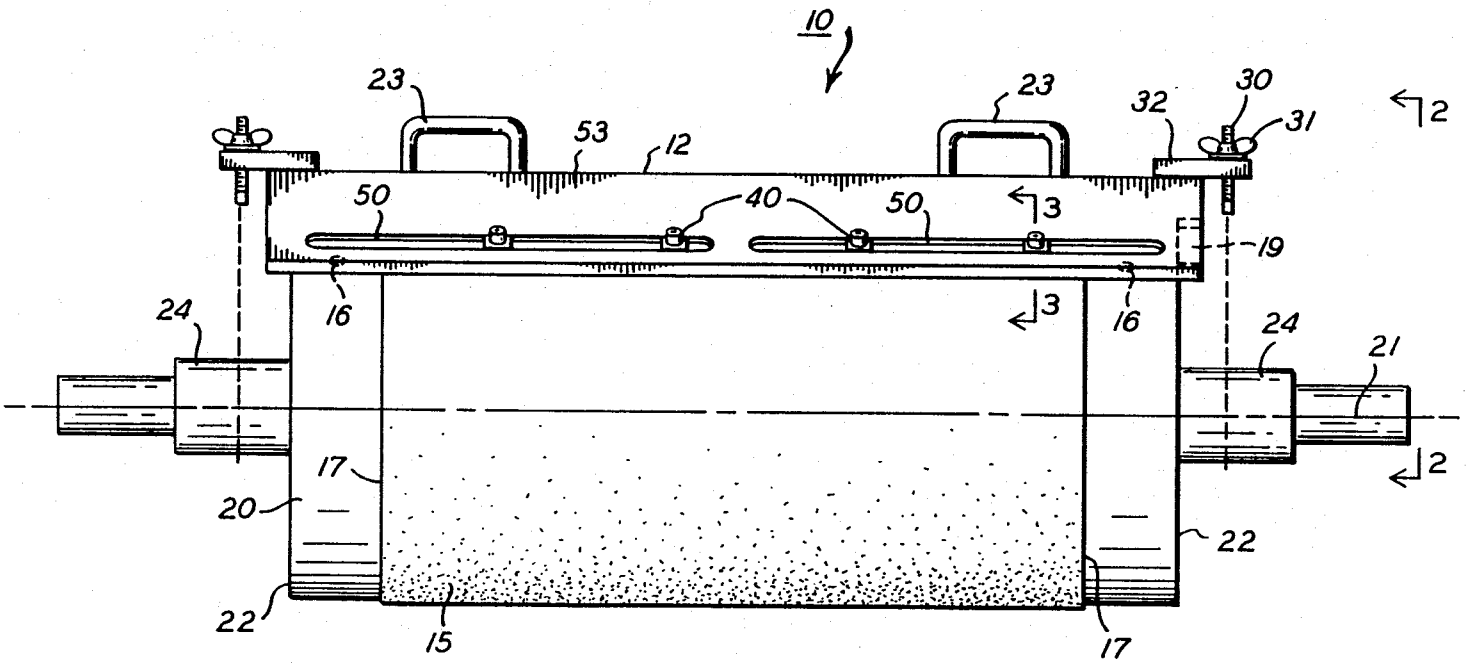
FIG. 1 is a partially schematic, front elevational view of a preferred embodiment of my pin bar, mounted on a print cylinder.

My pin bar 10 is preferably formed of a metallic angle bar 11, and I prefer aluminum for its light weight. When mounted on cylinder 20, as illustrated, angle bar 11 is disposed with its peak 12 facing upward, above cylinder 20, and its faces or legs 13 spanning a chord of the cylindrical print surface of cylinder 20. The opposite edges 14 of faces 13 provide bearing regions extending along two parallel lines so that two pairs of bearing regions spaced apart along edges 14 can all engage the cylindrical print surface of cylinder 20 to align bar 11 accurately parallel with the axis 21 of cylinder 20.

Figure 3:
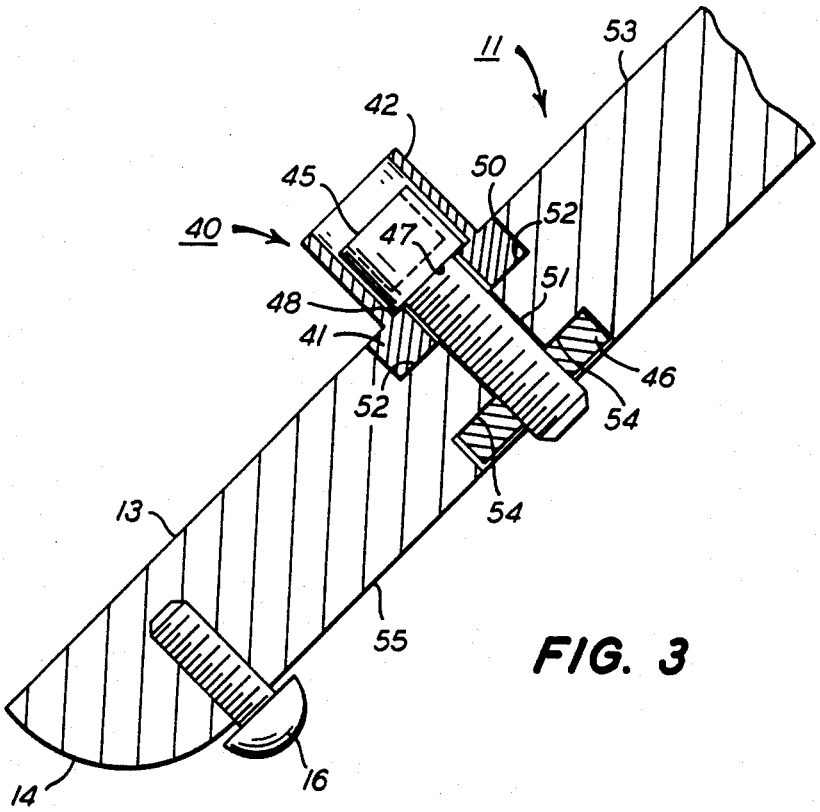
FIG. 3 is a fragmentary, cross-sectional view of the pin bar of FIG. 1, taken along the line 3—3 thereof.

Sticky back adhesive material 15 is wrapped around the circumference of cylinder 20 to receive flexographic plate 25, and sticky back 15 stands off somewhat from the cylindrical surface of cylinder 20. To keep the edges 14 of bar 11 from indenting into sticky back 15, bar 11 is made to stand off slightly from the print surface of cylinder 20. This is done preferably by feet 16 that can be pressed or threaded into bar 11, as shown in FIG. 3. Holes can be formed along the underside of edge regions 14 so that feet 16 can be positioned in different places along the length of pin bar 10. This allows feet 16 to be placed closer together for narrower cylinders and farther apart for wider cylinders. Feet 16 can then engage a cylinder 20 in regions between the edges 17 of sticky back 15 and the ends 22 of cylinder 20. The length of bar 11 between feet 16 can then span the width of sticky back 15 without engaging or indenting the sticky back material, which should remain accurately cylindrical to receive plate 25.

Figure 6:
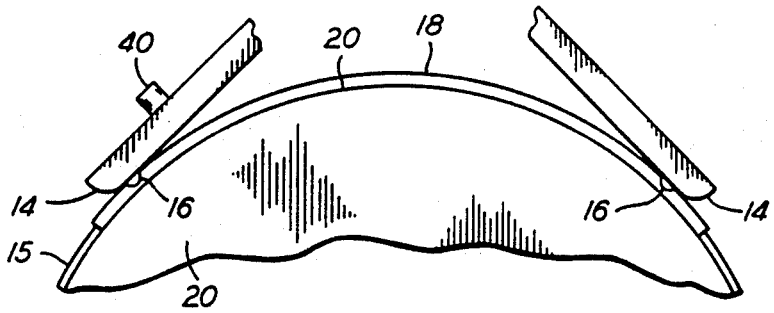
FIG. 6 is a fragmentary end elevational view of an alternative way of mounting the pin bar of FIGS. 1–3 on a cylinder.
Figure 7:
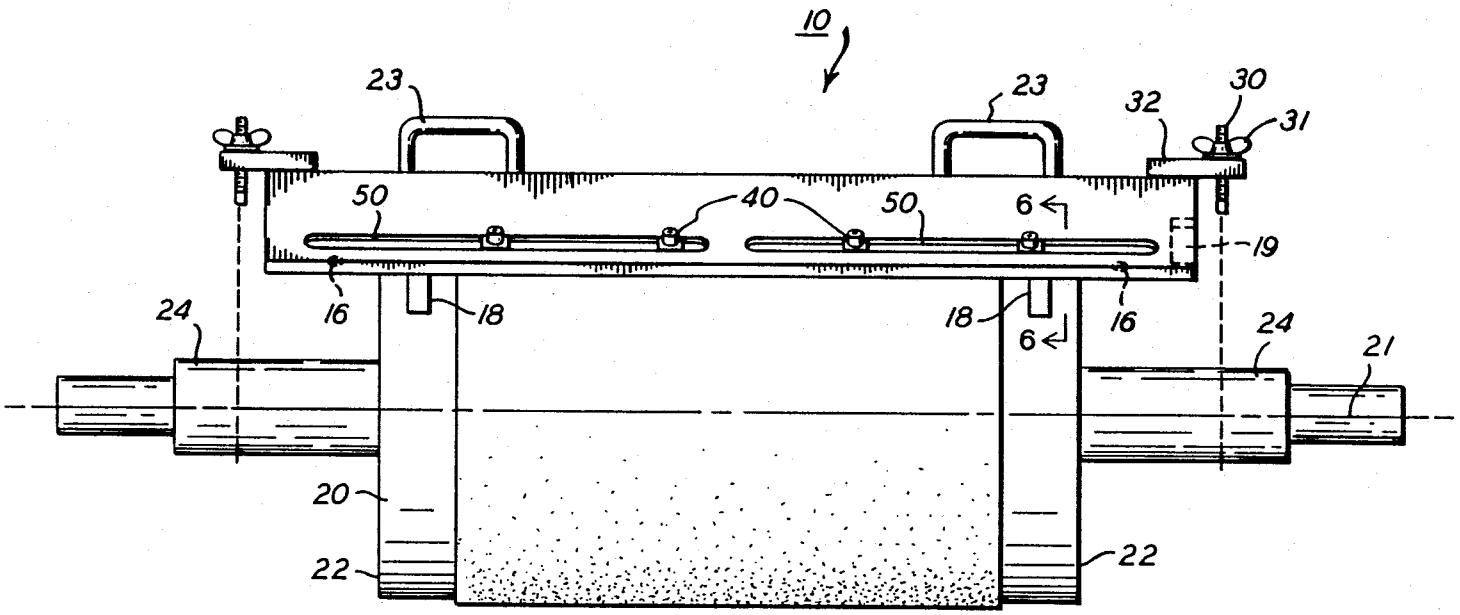
FIG. 7 is a fragmentary front elevational view of the alternative mounting of FIG. 6.

Another way that pin bar 10 can be mounted astraddle sticky back 15 is by using magnesium spacer strips 18 cut from magnesium printing plates. Strips 18 are readily bendable and accurately conform to the cylindrical print surface of cylinder 20, as shown in FIGS. 6 and 7. Strips 18 are also accurate and even in thickness so they can reliably raise bar edges 14 by the same amount above the print surface of cylinder 20. Feet 16 and spacer strips 18 thus accomplish a similar effect, and both allow bar 11 to be mounted accurately relative to the cylindrical print surface of cylinder 20 so as to be accurately parallel with the cylinder axis 21.

Axial location of pin bar 10 on cylinder 20 can also be accomplished in several ways. One way is to use an abutment block 19 secured to the undersurface of a bar face 13, to engage cylinder end 22. Another way is to position pin bar 10 so as to center plate 25 axially of cylinder 20 and place a mark on a bar face 13 in alignment with cylinder end 22. Print cylinders are axially adjustable to a small extent within a printing press, so that axial adjustment of pin bar 10 on cylinder 20 does not have to be exact.

Figure 2:
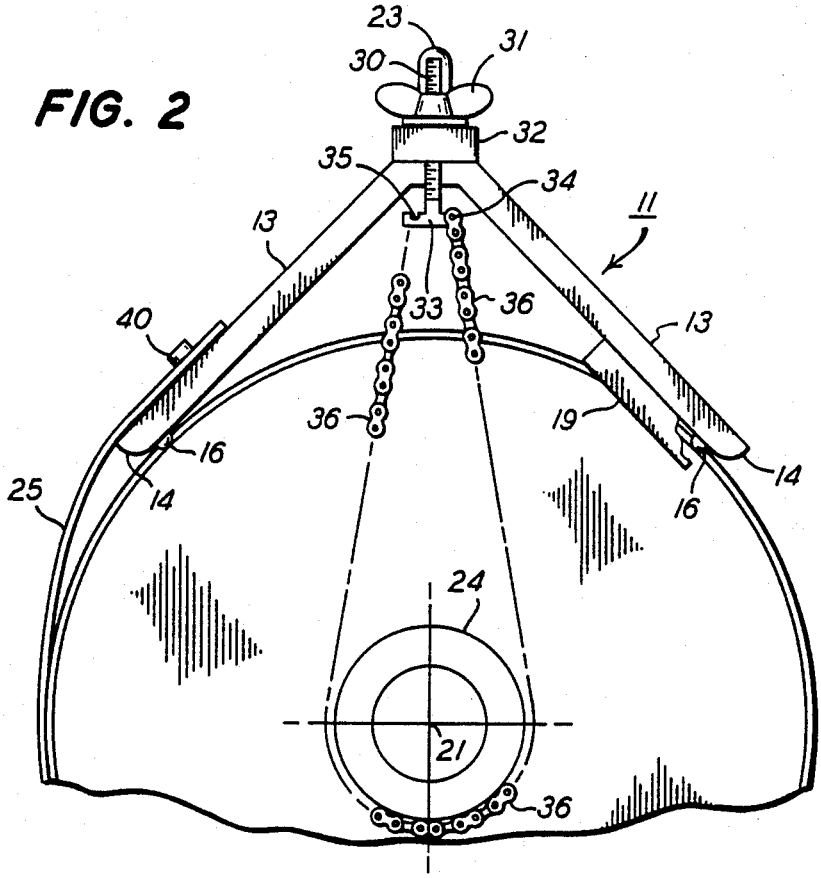
FIG. 2 is a fragmentary end elevational view of the pin bar and cylinder of FIG. 1, with a flexographic plate mounted on the pin bar.

Handles 23 extending upward from the top 12 of pin bar 10 are preferred for positioning pin bar 10 in the desired location on cylinder 20, with feet 16 or spacer strips 18 straddling sticky back 15. Once this position is set, pin bar 10 is clamped in position on cylinder 20 by means of a clamp at each end of pin bar 10. As best shown in FIG. 2, each clamp includes a screw 30 extending upward through bar 11 or through an end bracket 32, as illustrated. Each screw 30 has a hand nut 31, preferably in the form of a hand wheel or wing nut, as illustrated. The head 33 of each screw 31 extends transversely between a chain mount 34 and a chain hook 35. A pin 34 mounts one end of a chain 36 to head 33, and hook 35 can hook into any link of chain 36, which is preferably a bicycle or motorcycle chain. A variable length of chain 36 can be wrapped around cylinder shaft 24 to extend from screw head 33 down under shaft 24 and back up to hook 35. Then tightening hand nut 31 on screw 30 draws chain 36 tight around shaft 24 and pulls bar 11 downward against cylinder 20 to anchor pin bar 10 firmly in place. The use of chain 36 allows pin bar 10 to mount on cylinders 20 with different diameters and different shaft diameters. Also, since cylinder shafts 24 normally extend a considerable distance beyond the ends 22 of cylinder 20, a chain clamp can substantially overhang cylinder ends 22 and still wrap around cylinder shafts 24. This allows a long pin bar to fit on a short cylinder, as well as accommodate different diameters of cylinders and shafts.

Figure 4:
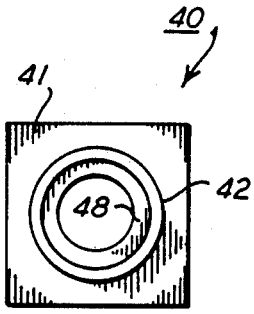
FIG. 4 is a plan view of a preferred embodiment of pin for use in the pin bar of FIGS. 1–3.
Figure 5:
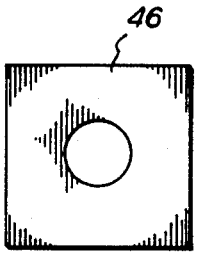
FIG. 5 is a plan view of a preferred nut for use in the pin bar of FIGS. 1–3.

Once pin par 10 is positioned and clamped in place, as explained above, then flexographic plate 25 can be mounted on pins 40. These, instead of being arranged at fixed locations along the length of pin bar 10, are axially movable within slots 50. The way I prefer doing this is best shown in FIGS. 3–5. Slot 50 has a central region 51 that extends through a face 13 of bar 11, and slot 50 is parallel with the cylinder bearing regions arranged along bar edges 14. Slot 50 also has reference surfaces 52 recessed into the upper face 53 of leg 13 of bar 11. References surfaces 52 are accurately parallel with upper face 13 and extend along the length of slot 50, which can be divided into several lengths aligned with each other and parallel with the bearing surfaces along the edges 14 of bar 11.

Each pin 40 has a bearing or guide block 41 that engages and rides along reference surfaces 52, which provide a footing holding the upper surface of bearing block 41 in the plane of face surface 53 and holding pin 40 accurately perpendicular to surface 53 of bar 11. Pin 40 also includes a cylindrical stud 42 extending upward from bar face 53 to fit into a hole drilled in plate 25. A set screw 45, preferably in the form of an allen screw, as illustrated, extends through the hollow interior of stud 42, through bearing block 41, and through the open portion 51 of slot 50. Screw 45 threads into a nut 46 on an underside of leg 13, and the head of screw 45 has a shoulder 47 that engages a shoulder 48 on bearing block 41 so that when screw 45 is tightened into nut 46 it draws bearing block 41 tightly against reference surfaces 52 and locks pin 40 securely in place. The underside of slot 50 preferably has recesses 54 recessed into the undersurface 55 of leg 13 and extending along opposite sides of slot 50 to receive nut 46. This locates nut 46 within the channel formed by recessed reference surfaces 54 to keep nut 46 from turning and to help ensure that stud 42 is set perpendicular to face 53 when set screw 45 is tightened.

Plate 25 can be drilled with different numbers of pin holes so that different numbers of pins 40 may be used on pin bar 10 to support a particular plate 25. Although plate drills are evenly spaced apart, drills can be omitted to leave gaps between holes, and the holes that are drilled can be variably positioned along the width of plate 25. Unused pins 40 can be loosened and slid to unused end regions of pin bar 10, and the selected number of pins can be loosely moved axially until they fit into the holes in plate 25. Then plate 25, and the pins 40 on which it is mounted, can be positioned axially of cylinder 20, and when suitably positioned, set screws 45 can be tightened to lock positioning pins 40 in their selected positions along slot 50. The freedom of axial movement of pins 40, while engaging plate 25, and before fitting into plate 25, facilitates the accurate positioning of plate 25 on cylinder 20.

The rest of the plate mounting process is already familiar. It involves removing a band of release sheet from sticky back 15, and adhering the positioned plate 25 to sticky back 15 to adhesively fix plate 25 in position. Then, plate 25 is removed from pins 40, pin bar 10 is removed from cylinder 20, the rest of the release sheet is removed from stickly back 15, and as this is done, plate 25 is wrapped around and adhered to sticky back 15, to complete the plate mounting.

When a single printing job requires several plates, as often happens, pin bar 10, with pins 40 set in the selected position for the first plate, is reused for mounting the other plates on their respective cylinders. Once all the plates of a printing job are properly mounted, pins 40 can be loosened as pin bar 10 is applied to a new plate mounting job. This may involve different diameters and widths of cylinders, different positioning of feet 16, or a different arrangement of spacer strips 18. Pin bar 10 can accommodate much of such variation, because of its versatile clamping and mounting system and its axially movable pins.

I claim:

1. A pin bar for mounting flexographic printing plates on print cylinders, said pin bar comprising:

a. said bar having two pairs of bearing regions spaced apart on two parallel lines so that said bearing regions can all engage the cylindrical print surface of one of said print cylinders, and when so engaged with said cylindrical surface, said bearing regions align said bar parallel with the axis of the engaged cylinder;

b. an axial slot in said bar extending parallel with said lines for said bearing regions so that said axial slot is parallel with said axis of said engaged cylinder when said bearing regions engage said cylindrical print surface of said cylinder;

c. a plurality of plate alignment pins positionable along said axial slot;

d. axial positions of said alignment pins along said axial slot being parallel with said axis of said engaged cylinder, because of said bearing regions engaging said cylindrical print surface of said cylinder; and e. a clamp arranged at each opposite end region of said bar, each of said clamps having a tension element that can be wrapped around a shaft of said engaged cylinder and be drawn tight to hold said bearing regions of said bar firmly in engagement with said cylindrical surface.

2. The pin bar of claim 1 wherein said bar is formed as an angle bar with said bearing regions arranged along opposite ends of said bar and said slot arranged in a face of said bar spaced from an edge of said bar.

3. The pin bar of claim 1 wherein said tension element is a chain.

4. The pin bar of claim 1 wherein said clamp includes a screw extending through said bar and tightened by a hand nut, a mounted end of said chain in connected to a head of said screw, and said screw head includes a hook for engaging a link of said chain spaced from said mounted end.

5. The pin bar of claim 1 wherein reference surfaces are recessed into said bar on opposite sides of said slot, and said pins include guide blocks engaging said reference surfaces.

6. The pin bar of claim 1 wherein set screws extend axially through said pins into nuts disposed on an underside of said slot.

7. The pin bar of claim 6 wherein said nuts guide in recesses formed on opposite sides of said underside of said slot.

8. The pin bar of claim 1 wherein said bar has an abutment surface for engaging an end face of said cylinder.

9. The pin bar of claim 1 wherein said bearing regions comprise feet extending below an undersurface of said bar.

10. A flexographic pin bar comprising:

a. an angle bar having four bearing regions arranged along parallel edges of said bar so that all four bearing regions can engage a cylindrical print surface of a print cylinder to hold said bar parallel with the axis of said print cylinder;

b. said bar having a pin slot extending parallel with said bearing regions so that said slot is parallel with said axis of said print cylinder when all four of said bearing regions engage said cylindrical print surface of said print cylinder;

c. a plurality of plate holding pins positionable along said slot;

d. said slot having a reference surface recessed relative to an upper surface of said bar and parallel with said upper surface of said bar, said reference surface being engaged by surfaces of said pins perpendicular to axes of said pins, for holding said pins perpendicular with, and extending above, said upper surface of said bar; and e. set screws for setting said perpendicular surfaces of said pins against said reference surface of said slot in selected axial positions along said slot, said axial positions being parallel with said axis of said print cylinder, by virtue of said bearing regions engaging said cylindrical print surface of said print cylinder.

11. The pin bar of claim 10 wherein end regions of said bar include clamps engaging shafts of said print cylinder for holding said bearing regions in engagement with said cylindrical print surface of said print cylinder.

12. The pin bar of claim 11 wherein said clamps include chains that wrap around said shafts and are drawn tight by a hand nut on a screw.

13. The pin bar of claim 12 wherein one end of each of said chains is connected to a respective head of each of said screws, and each of said screw heads has a hook disposed for engaging and holding a link of each respective chain.

14. The pin bar of claim 10 including an abutment surface on an underside of said bar for engaging an end face of said cylinder.

15. The pin bar of claim 10 wherein said set screws extend axially through said pins into nuts disposed on an underside of said slot.

16. The pin bar of claim 15 wherein said underside of said slot is recessd to receive said nuts.

17. The pin bar of claim 10 wherein said bearing regions comprise feet extending below an undersurface of said bar.

18. A pin bar having a pin and pin holding slot for mounting flexographic printing plates on print cylinders, said pin bar comprising:

a. said slot being formed in an upper face of said bar to extend axially of an engaged one of said cylinders;

b. said slot having a central portion extending through said bar and side portions recessed into said upper face of said bar and disposed parallel with said upper face of said bar to form reference surfaces for said pin;

c. said pin having a guide block movable along said side portions of said slot, said guide block having a bottom surface perpendicular with an axis of said pin and disposed to engage said reference surfaces, so that said perpendicular surface of said guide block holds said pin perpendicular with said upper face of said bar, to extend above said upper face of said bar; and d. said pin being hollow and having a set screw extending axially through said pin and through said central region of said slot to be threaded into a nut disposed on an undersurface of said bar.

19. The pin bar of claim 18 wherein said bar is an angle bar and said slot is formed parallel with an edge of said angle bar.

20. The pin bar of claim 18 wherein said side portions of said slot are also recessed into said undersurface of said bar, and said nut is disposed in said undersurface recesses.

21. The pin bar of claim 18 wherein said screw has a head engaging an internal shoulder of said pin.

22. The pin bar of claim 18 including a plurality of pins mounted for movement in said slot.

23. The pin bar of claim 18 including a plurality of said slots aligned with each other along the length of said bar.

24. A pair of clamps for a pin bar for mounting flexographic plates on a printing cylinder to which said pin bar is clamped, said clamps comprising:

a. each of said clamps having a screw that passes through an end region of said pin bar extending axially beyond end regions of said printing cylinder, a hand nut being threaded onto each of said screws above said pin bar;

b. each of said screws having a transverse head arranged below said top of said pin bar, beyond said ends of said printing cylinder, one end of said head mounting a length of chain, and the other end of said head having a hook for engaging a link of said chain; and c. said chain being disposed to extend downward beyond ends of said printing cylinder to wrap around a shaft of said printing cylinder and extend back up to said hook so that tightening said hand nut draws said screw head upward, tightens said chain around said shaft, and pulls said pin bar down into an engagement with said printing cylinder, which accurately aligns said pin bar parallel with the axis of said printing cylinder.

25. The clamps of claim 24 wherein said screw extends upward through a hole in said pin bar.

* * * * *